US012497743B2

(12) United States Patent
Gates et al.

(10) Patent No.: US 12,497,743 B2
(45) Date of Patent: Dec. 16, 2025

(54) CONVERTIBLE SNOW PLOW

(71) Applicant: Douglas Dynamics, L.L.C., Milwaukee, WI (US)

(72) Inventors: Gatesy R.C.D. Gates, Liberty, ME (US); Andre Valmont Leblond, Rockport, ME (US)

(73) Assignee: Douglas Dynamics, L.L.C., Milwaukee, WI (US)

( * ) Notice: Subject to any disclaimer, the term of this patent is extended or adjusted under 35 U.S.C. 154(b) by 826 days.

(21) Appl. No.: 17/655,189

(22) Filed: Mar. 17, 2022

(65) Prior Publication Data

US 2023/0295888 A1 Sep. 21, 2023

(51) Int. Cl.
*E01H 5/06* (2006.01)
*E02F 3/815* (2006.01)

(52) U.S. Cl.
CPC ..... *E01H 5/061* (2013.01); *E02F 3/8155* (2013.01)

(58) Field of Classification Search
CPC .. E01H 5/00; E01H 5/06; E01H 5/061; E01H 5/067; E02F 3/7613; E02F 3/815; E02F 3/8155; E02F 3/84; E02F 3/844
USPC ..... 172/810, 811, 815, 818, 819, 820; 37/234, 266, 272, 273, 274
See application file for complete search history.

(56) References Cited

U.S. PATENT DOCUMENTS 3,994,081 A * 11/1976 Middleton ..... E01H 5/04 37/283
5,829,174 A * 11/1998 Hadler ..... E01H 5/06 37/234
6,253,470 B1 7/2001 Depies et al.
9,200,418 B2 12/2015 Jones et al.
9,822,563 B2 11/2017 Jones et al.
10,472,783 B2 11/2019 Rich
2009/0282706 A1 11/2009 Barker et al.
2016/0053451 A1* 2/2016 Behan ..... E01H 5/04 37/270
2020/0032469 A1 1/2020 Rich

OTHER PUBLICATIONS

Ariens, Snow Blowers and Snow Removal Equipment—Mammoth Series, online brochure, (https://www.ariens.com/en-us/power-equipment/snow-products/vehicle/mammoth), Oct. 28, 2021.

* cited by examiner

*Primary Examiner* — Christopher J Sebesta
*Assistant Examiner* — Evan A Bregel
(74) *Attorney, Agent, or Firm* — Wood Herron & Evans LLP

(57) ABSTRACT

A convertible snow plow comprises a support frame having a forward end and a rearward end, the rearward end adapted to be mounted to a vehicle, a pair of plow blades hinged together along inboard ends of the blades at a hinge at the forward end of the support frame, an actuator having opposite ends, one end connected to the support frame, and a two-position linkage connected to the other end of the actuator and to at least one of the blades. When the linkage is in the first position the blades are in a straight blade configuration and the actuator is operable to position the blades in straight blade forward, straight blade left, and straight blade right positions, and when the linkage is in the second position the blades are in a V-blade configuration and the actuator is operable to position the blades in forward swept V and rearward swept V positions.

20 Claims, 12 Drawing Sheets

CONVERTIBLE SNOW PLOW

RELATED APPLICATIONS

N/A

FIELD OF THE INVENTION

This invention relates generally to snow plows, and more particularly to snow plows of the straight-blade variety and the V-blade variety.

BACKGROUND OF THE INVENTION

Vehicle mounted snow plows currently in use are generally of either the single-blade or straight-blade variety, or of the center-hinged dual-blade variety known as V-blade plows, or simply V-plows. A straight blade plow can be oriented either generally perpendicular to the longitudinal axis of the vehicle so as to push snow forward straight ahead, or pivoted right towards the passenger side of the vehicle (clockwise when viewed from above) or left towards the driver side of the vehicle (counterclockwise when viewed from above) as desired so as to push snow to the desired side of the vehicle. In addition to these configurations, a V-plow can also pivot its dual blades relative to each other, permitting a rearward sweeping V-shaped configuration that pushes snow simultaneously to both the passenger and driver sides of the vehicle, and permitting a forward sweeping V-shaped configuration (also known as the "scoop" configuration) for scooping snow and pushing it forward.

In the case of both straight blade plows and V-plows, hydraulics are utilized to move the blades into their various configurations. V-plows tend to be more costly due to the complexities of their hydraulic systems. The requirement to be able to articulate the blades independently and together requires a programmable logic controller, hydraulic blocks with many valves, and at least two dual acting hydraulic piston/cylinder units, also known as hydraulic rams (one for each blade).

Snow plows may be mounted to many types of vehicles. For example, snow plows may be mounted on passenger vehicles, such as pickup trucks, or on smaller off-road vehicles such as all-terrain vehicles ("ATV's"), utility-terrain vehicles ("UTV's"), or miniature stand on skid steers. One example of the latter is the Ariens Mammoth 850 miniature stand on skid steer. For these types of off-road vehicles, a less complex, less expensive, and lighter weight V-plow is desired.

Prior attempts at reducing the complexity and cost associated with V-plows have centered around removing the two hydraulic rams altogether, manually positioning the blades, and pinning the blades to lock them in place. While such attempts certainly reduce the complexity and cost of a V-plow, the efficiency and functionality of plowing is degraded due to the requirement that the operator must stop plowing, disembark the vehicle, position the blades, lock the blades in place, embark the vehicle, and resume plowing. This is compounded by the five possible configurations that may be chosen: straight blade forward, straight blade angled left, straight blade angled right, forward swept V, and rearward swept V. Manually adjusted blades pinned in place also offer no hydraulic cushion relief in the event that an obstacle is encountered during plowing.

Accordingly, a less complex, less expensive, and lighter weight V-plow is desired, but that does not suffer the drawbacks of prior attempts at reducing the complexity and cost of V-plows.

SUMMARY OF THE INVENTION

In one aspect, a convertible snow plow comprises a support frame having a forward end and a rearward end, the rearward end adapted to be mounted to a vehicle, a pair of plow blades hinged together along inboard ends of the blades at a hinge at the forward end of the support frame, an actuator having opposite ends, one end connected to the support frame, and a two-position linkage connected to the other end of the actuator and to at least one of the blades. When the linkage is in the first position the blades are in a straight blade configuration and the actuator is operable to position the blades in straight blade forward, straight blade left, and straight blade right positions, and when the linkage is in the second position the blades are in a V-blade configuration and the actuator is operable to position the blades in forward swept V and rearward swept V positions.

The linkage can include a drive link and a connecting link, each having opposite ends. When the linkage is in the first and second positions one end of the drive link is connected to one of the blades and the other end of the drive link is connected to the other end of the actuator, when the linkage is in the first position one end of the connecting link is connected to one of the blades and the other end of the connecting link is connected to the other of the blades, and when the linkage is in the second position the other end of the connecting link is connected to the other end of the actuator. The connection of the drive link to the actuator can ride in a transversely centered and longitudinally extending slot in the support frame. The one end of the actuator can be connected to the rearward end of the support frame in line with a longitudinal axis of the slot. When the linkage is in the first position one end of the connecting link can be connected to one of the blades at a first location on the one blade, and when the linkage is in the second position the one end of the connecting link can be connected to the one blade at a second different location on the one blade. The first location can be aft of the second location. When the linkage is in the first position the connecting link has a first effective length, and when the linkage is in the second position the connecting link has a second effective length; the first effective length can be longer than the second effective length. The actuator can be a single dual-acting hydraulic ram. The vehicle can be an ATV, a UTV, or a miniature stand on skid steer.

In another aspect, a convertible snow plow comprises a support frame having a forward end and a rearward end, the rearward end adapted to be mounted to a vehicle, a pair of plow blades hinged together along inboard ends of the blades at a hinge at the forward end of the support frame, an actuator having opposite ends, one end connected to the support frame, and a linkage connected to the other end of the actuator and to at least one of the blades. The actuator is operable to position the blades in straight blade forward, straight blade angled left, straight blade angled right, forward swept V, and rearward swept V positions.

The linkage can include a pair of links. Opposite ends of one of the links can be connected in a first manner for straight blade configuration and in a second different manner for V-blade configuration, and opposite ends of the other link can be connected in the same manner for straight blade configuration and for V-blade configuration. One of the links can be a connecting link and the other link can be a drive link. The linkage can be configured such that only the drive link is connected to the actuator for straight blade configuration and both links are connected to the actuator for V-blade configuration. The actuator can be a single dual-acting hydraulic ram. The vehicle can be an ATV, a UTV, or a miniature stand on skid steer.

In another aspect, a method of converting a snow plow from a straight blade configuration to a V-blade configuration comprises providing a support frame having a forward end and a rearward end, the rearward end adapted to be mounted to a vehicle, providing a pair of plow blades hinged together along inboard ends of the blades at a hinge at the forward end of the support frame, providing an actuator having opposite ends, one end connected to the support frame, providing a two-position linkage connected to the other end of the actuator and to at least one of the blades, connecting the linkage in the first position, energizing the actuator to position the blades in straight blade forward, straight blade angled left, and straight blade angled right positions, connecting the linkage in the second position, and energizing the actuator to position the blades in forward swept V and rearward swept V positions.

The linkage can include a drive link and a connecting link, wherein opposite ends of the connecting link are connected in a first manner for straight blade configuration and in a second different manner for V-blade configuration, and wherein opposite ends of the drive link are connected in the same manner for straight blade configuration and for V-blade configuration. The linkage can be configured such that only the drive link is connected to the actuator for straight blade configuration and both links are connected to the actuator for V-blade configuration. The actuator can be a single dual-acting hydraulic ram.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Referring first to FIGS. 1-4, a convertible snow plow 10 according to the principles of the present invention is illustrated. The plow 10 has a V-blade assembly 20, a support frame 30, and a mounting plate 40.

Figure 1:
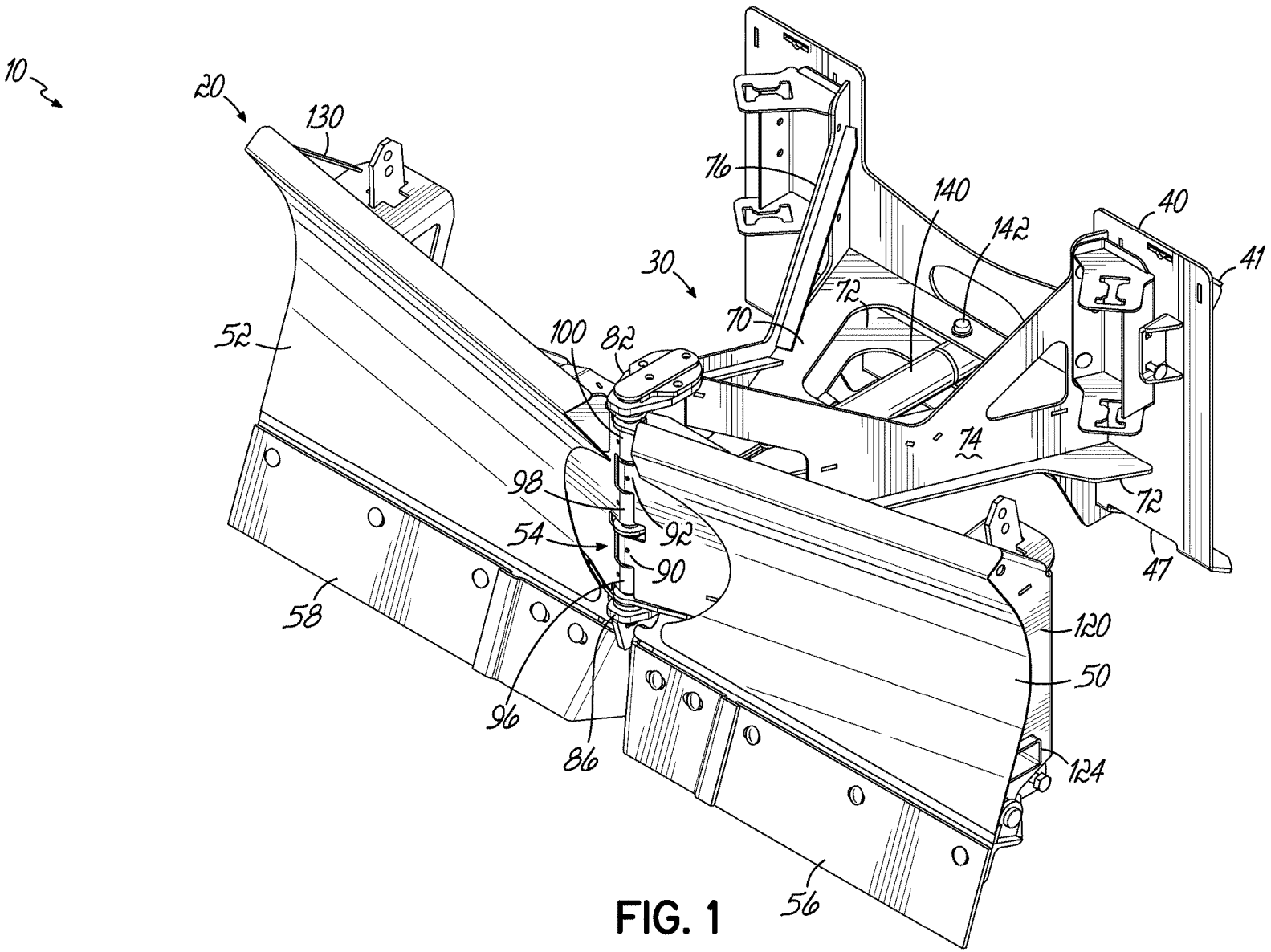
FIG. 1 is a left front perspective view of the convertible snow plow.
Figure 2:
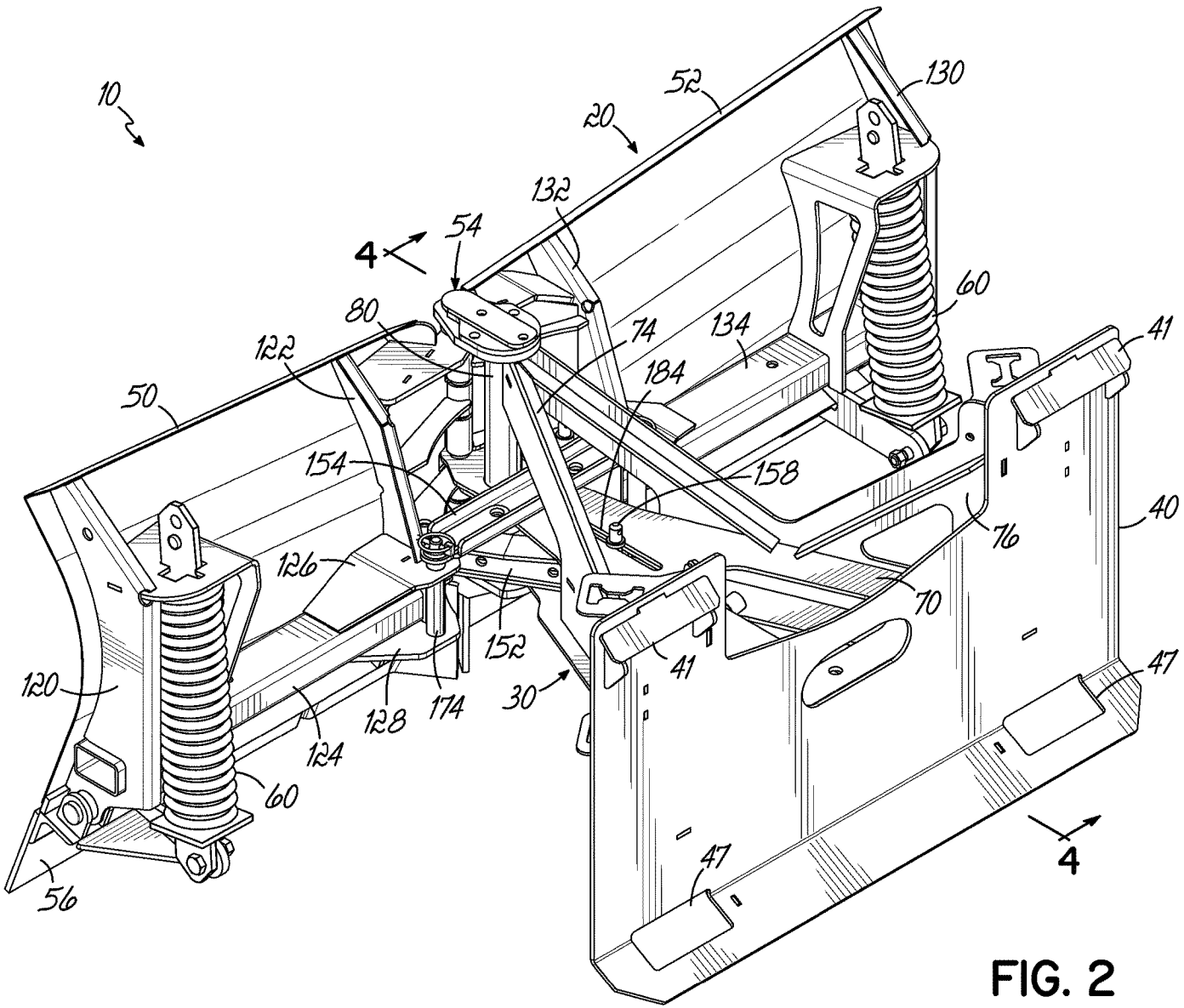
FIG. 2 is a left rear perspective view.
Figure 3A:
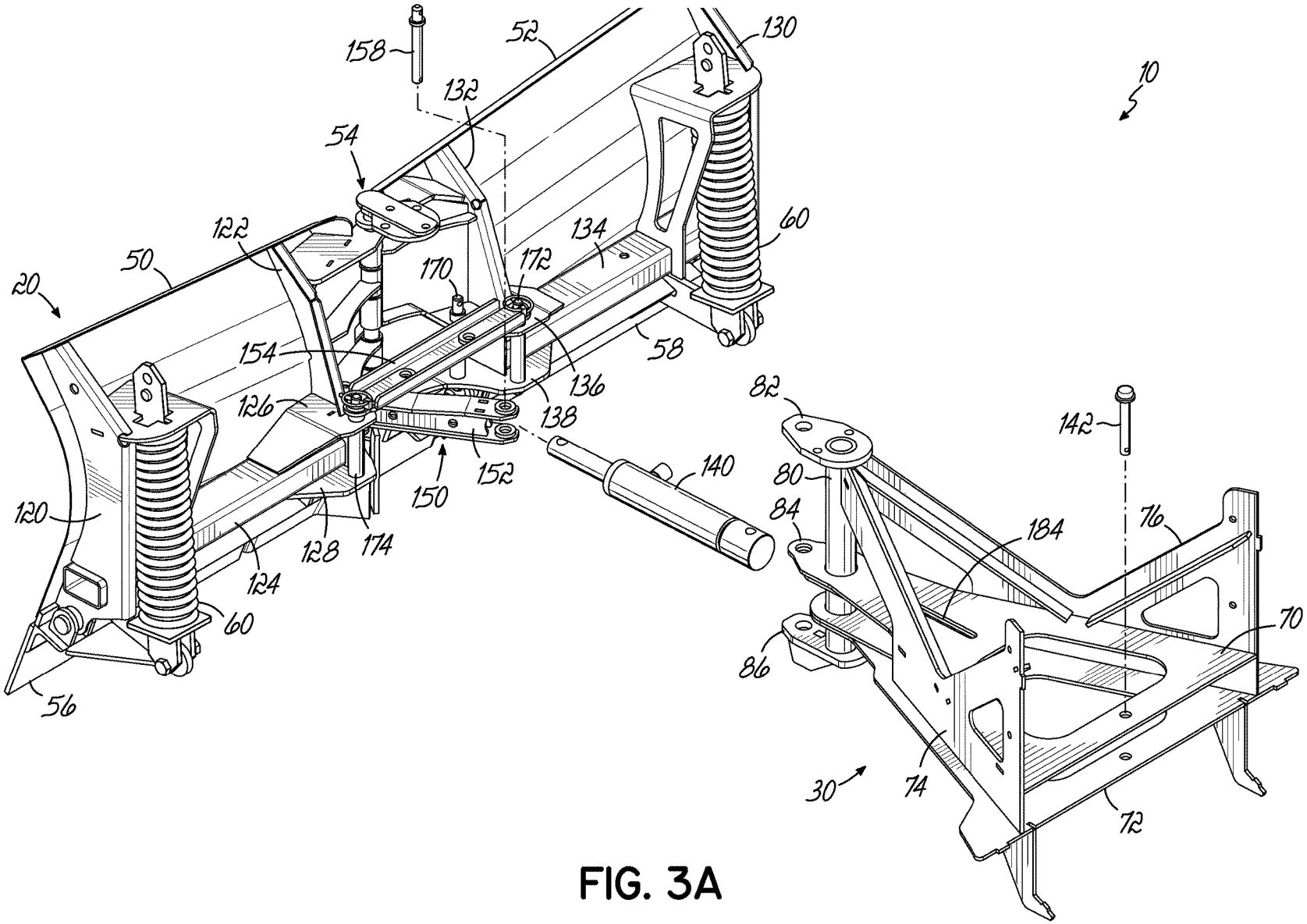
FIG. 3A is a left rear exploded perspective view.
Figure 3B:
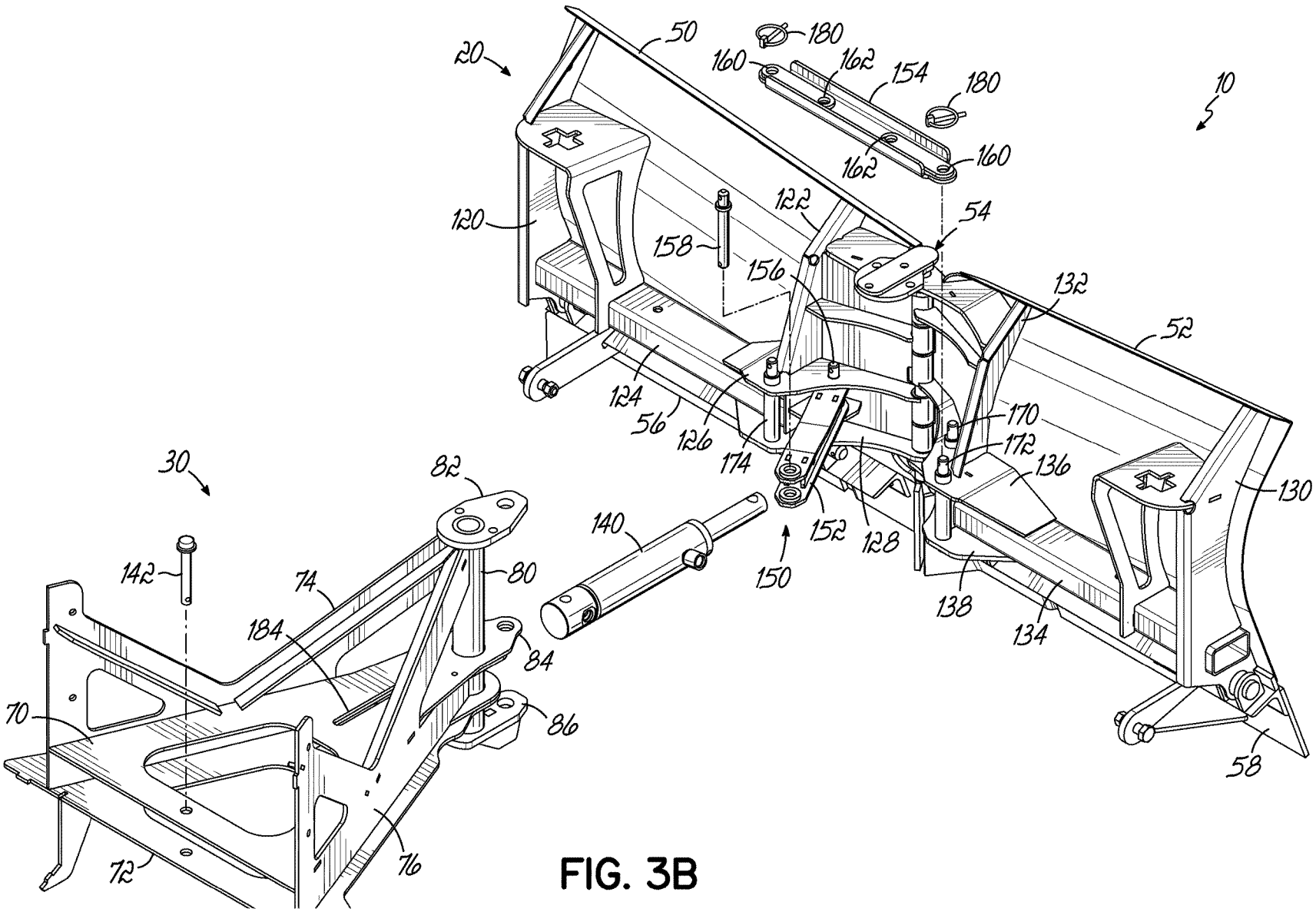
FIG. 3B is a right rear exploded perspective view.
Figure 3C:
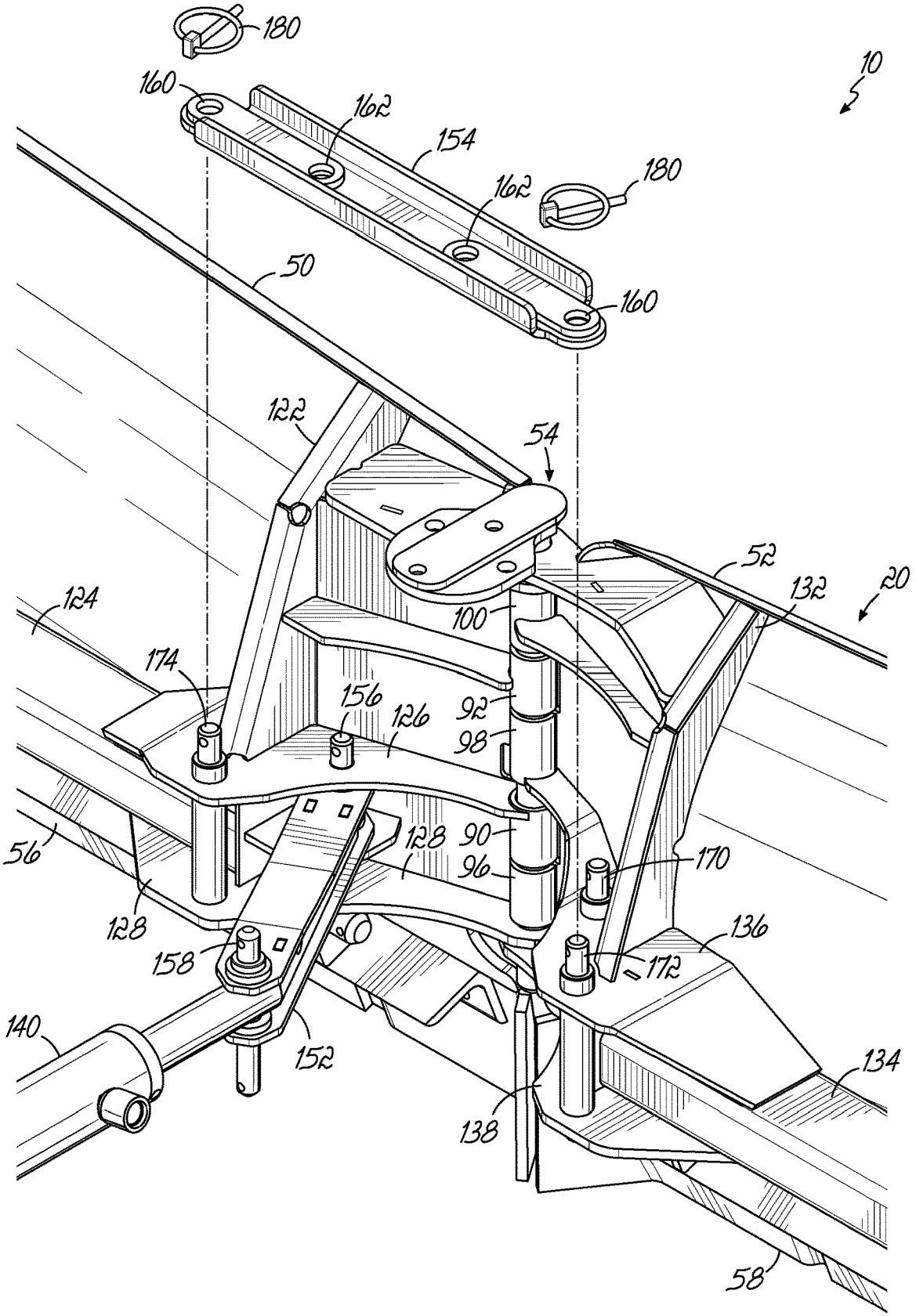
FIG. 3C is an enlarged right rear exploded perspective view.
Figure 4:
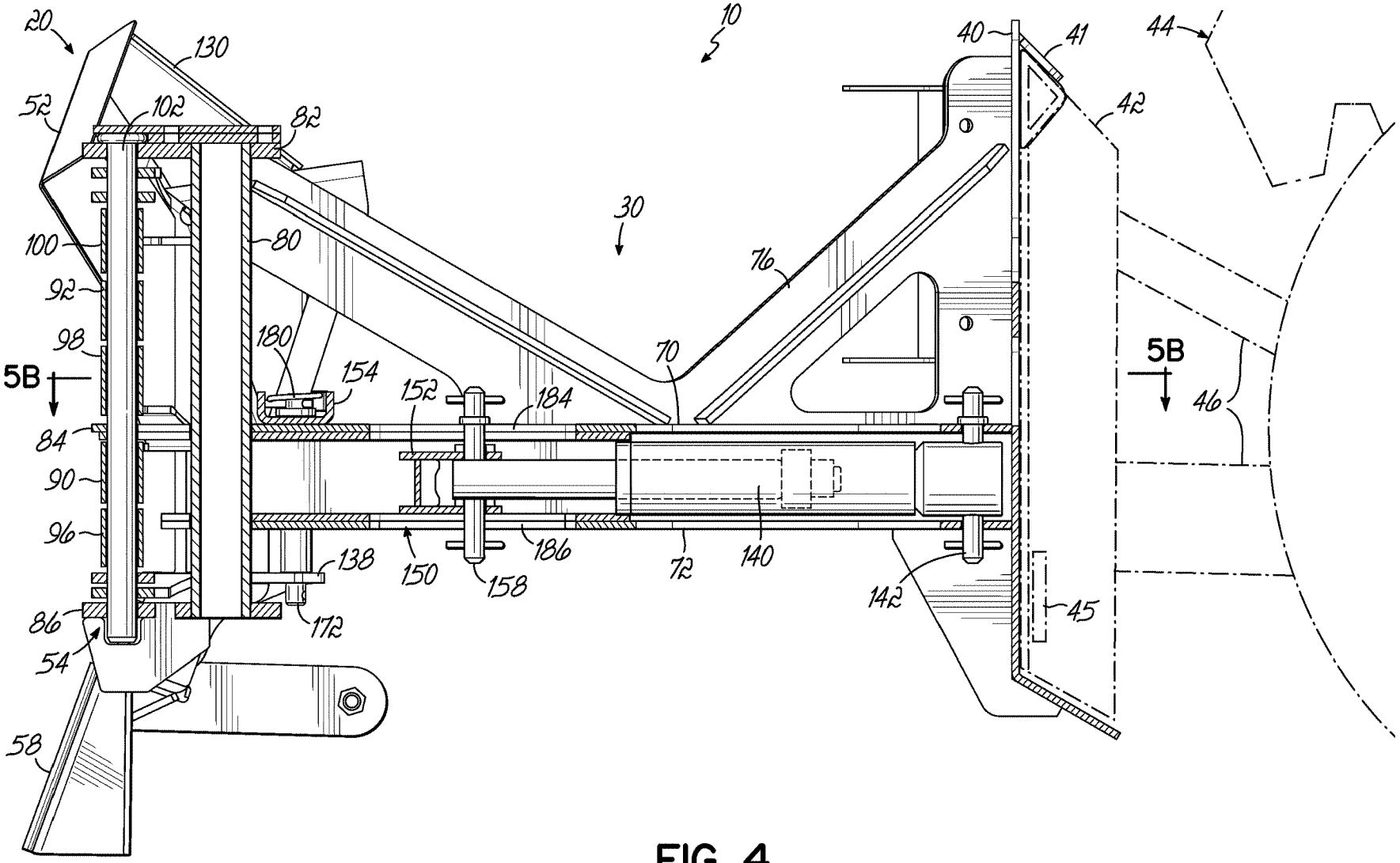
FIG. 4 is a cross-sectional view taken along line 4-4 in FIG. 2.

V-blade assembly 20 is connected to support frame 30 at a forward end of support frame 30 for pivotal movement relative to support frame 30 about a generally vertical axis. Support frame 30 is fixedly connected to mounting plate 40. Referring to FIG. 4, plow mounting plate 40 is engaged by a complimentary vehicle mounting plate 42 carried by a plow vehicle 44, for example the aforementioned Ariens Mammoth 850 miniature stand on skid steer. The upper edge of plow mounting plate 40 includes a spaced apart pair of downwardly angled tabs 41 that are engaged from underneath by a spaced apart pair of cooperating and matingly upwardly angled wedges 43 on the upper edge of vehicle mounting plate 42. A pair of spaced apart latches 45 on the lower edge of vehicle mounting plate 42 latch into a pair of cooperating spaced apart openings 47 in the lower edge of plow mounting plate 40 to secure plow mounting plate 40 to vehicle mounting plate 42. Vehicle 44 includes suitable connecting structure and hydraulic ram 46 to pivot vehicle mounting plate 42 and hence plow mounting plate 40 and plow 10 upwardly and downwardly about a generally horizontal axis generally transverse to the longitudinal axis of vehicle 44.

V-blade assembly 20 comprises a pair of blades 50, 52 hinged together along inboard ends thereof as at hinge assembly 54 for pivotal movement relative to one another about the generally vertical axis of the hinge assembly 54. Blades 50, 52 include trip cutting edge plates 56, 58, respectively, pivotally mounted to the lower edges of blades 50, 52. Each cutting edge plate 56, 58 is spring biased forwardly via a compression spring 60 operable between each blade 50, 52 and its respective cutting edge plate 56, 58. This arrangement permits each cutting edge plate 56, 58 to "trip," i.e. pivot rearwardly about a generally horizontal axis generally parallel to its respective blade 50, 52. In this way, when an obstacle is encountered during plowing, the lower (cutting) edge of the cutting edge plate 50, 52 can travel up and over the obstacle, and once the obstacle has been passed, return to the forward position.

Hinge assembly 54 is supported by or is otherwise formed as a part of support frame 30. Support frame 30, sometimes called an A-frame, includes a pair of parallel generally A-shaped plates 70, 72 connected with a left hand or driver side support plate 74 and a right hand or passenger side support plate 76. A post 80 is located near a forward end of support frame 30 and is interconnected with plates 70, 72 and plates 74, 76. Hinge assembly 54 is formed by hinge lugs 82, 84, 86 on support frame 30, hinge leaves 90, 92, on left hand (driver side) blade 50, hinge leaves 96, 98, and 100 on right hand (passenger side) blade 52, and hinge pin 102.

Additional details of a V-blade arrangement with trip cutting edges can be seen with reference to the Assignee's U.S. Pat. No. 9,200,418, which is hereby incorporated by reference herein as if fully set forth in its entirety.

Blade 50 includes vertical ribs 120, 122 and a push beam 124, all secured to a rear side of blade 50. Upper and lower horizontal ribs 126, 128 are tied into blade 50, rib 122, and push beam 124. Similarly, blade 52 includes vertical ribs 130, 132 and a push beam 134, all secured to a rear side of blade 52. Upper and lower horizontal ribs 136, 138 are tied into blade 52, rib 132, and push beam 134.

The piston cylinder end of a dual-acting hydraulic ram 140 is positioned between, and is pinned to the aft ends of, plates 70, 72 via a pin 142. The piston rod end of ram 140 is connected to a two-position linkage 150, itself connected to horizontal ribs 126, 128, 136, 138, in a manner described in more detail below. The dual-acting hydraulic ram 140 is powered by a bidirectional motor/pump combination. One suitable such dual-acting ram is manufactured by the Assignee as part number 79627. Advantageously, all five plow positions/configurations — straight blade forward, straight blade angled left, straight blade angled right, forward swept V, and rearward swept V—are accomplished with a single dual-acting hydraulic ram.

More particularly, linkage 150 comprises a drive link 152 and a connecting link 154. Horizontal ribs 126, 128 are interconnected by a pin or post 156. Drive link 152 is a dual link having forward ends connected to pin 156. The aft ends of drive link 152 accept the piston rod end of ram 140 therebetween, which is pinned thereto via a pin 158.

Connecting link 154 is connected in one of two ways, depending on if the plow 10 is desired to be configured as a straight blade plow or a V-plow. More particularly, connecting link 154 is of a generally U-shaped or channel cross-section, each end having a hole 160 therethrough and further including two additional holes 162 therethrough, the holes 162 being spaced along link 154 in such a way that link 154 is a mirror image of itself, or is otherwise symmetrical, when taken about a transverse axis medially of the ends of the link 154. In this way, link 154 can be installed without regard to end. Alternatively, link 154 can simply be a flat bar, with only three holes instead of four.

Horizontal ribs 136, 138 are interconnected by two pins or posts, a forward pin 170 and an aft pin 172. Horizontal ribs 126, 128 are interconnected by an additional pin or post 174. Pins 172, 174 are mirror images of one another, or are otherwise symmetrical, when taken about the longitudinal axis of the vehicle passing through the vertical pivot axis of hinge assembly 54. Similarly, pins 156, 170 are mirror images of one another, or are otherwise symmetrical, when taken about the longitudinal axis of the vehicle passing through the vertical pivot axis of hinge assembly 54. When it is desired to configure the plow 10 as a straight blade plow (first position of linkage 150), connecting link 154 is positioned over pins 172, 174 such that the upper ends of pins 172, 174 pass through holes 160 in connecting link 154. Connecting link 154 is secured in this first position by linchpins 180. Connecting link 154 thus locks blades 50, 52 together in a parallel or straight blade configuration. See FIGS. 5A-5C.

When it is desired to configure the plow 10 as a V-blade plow (second position of linkage 150), connecting link 154 is positioned over pin 170 such that the upper end of pin 170 passes through one of the holes 160. Pin 158 is passed through the hole 162 furthest from that one hole 160, through aft ends of drive link 152 and through piston rod end of ram 140. Connecting link 154 is likewise secured in this second position by linchpins 180. Drive link 152 and connecting link 154 thus form a scissors linkage in this second position. See FIGS. 6A-6C.

Figure 5A:
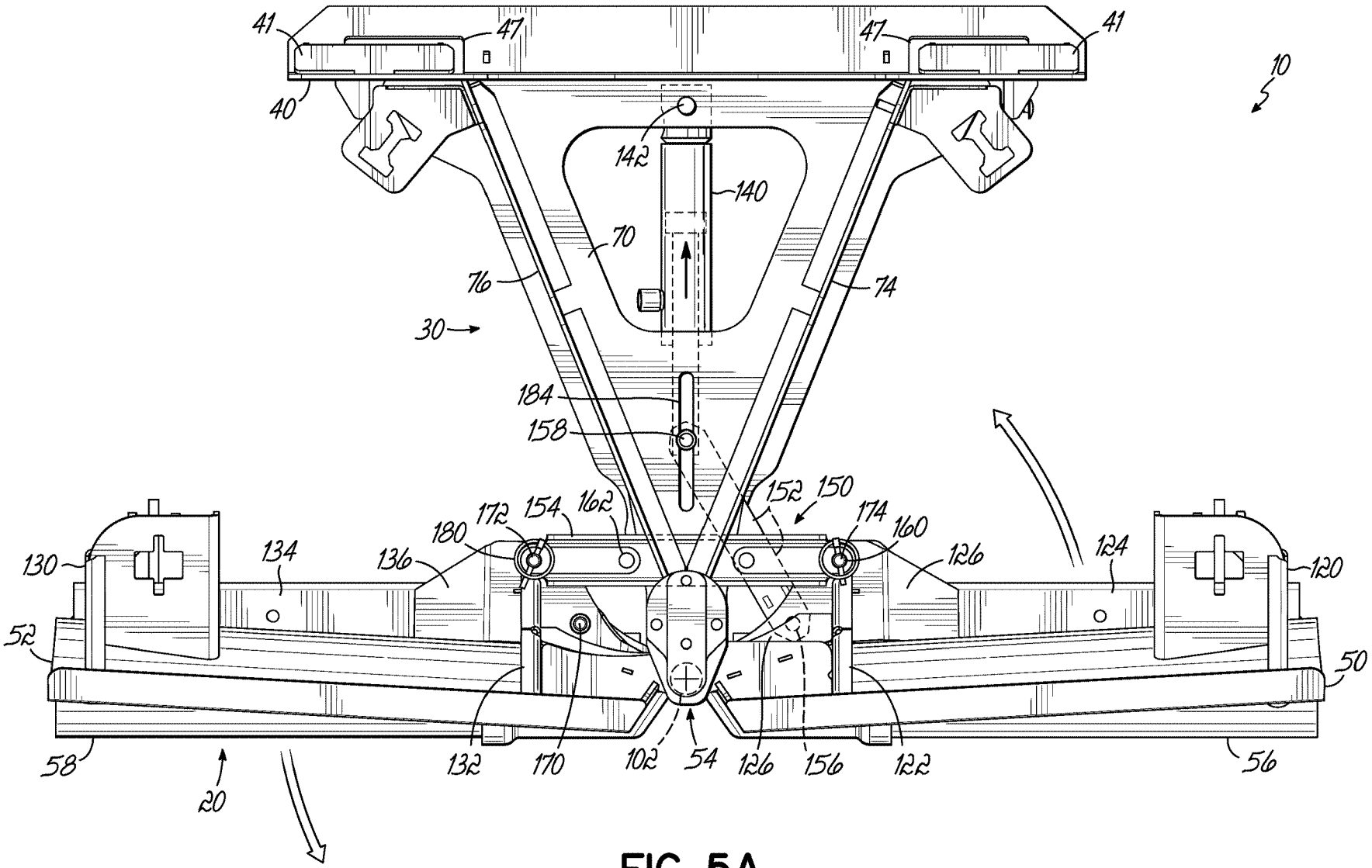
FIG. 5A is a top view, the linkage in the first position, in straight blade configuration, the blades in the forward position.
Figure 5B:
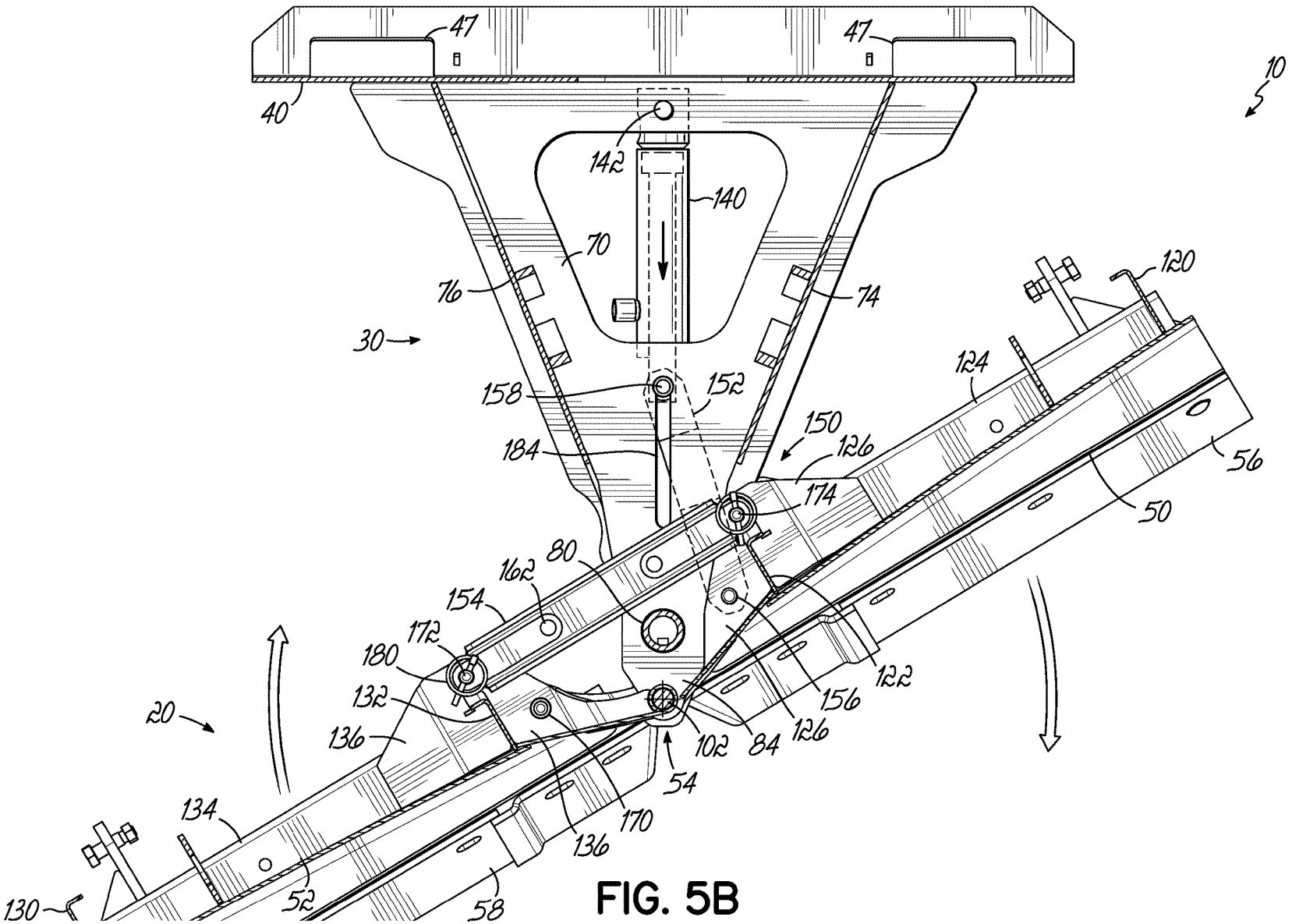
FIG. 5B is a partial cross-sectional view taken along line 5B-5B in FIG. 4, the blades in the angled left position.
Figure 5C:
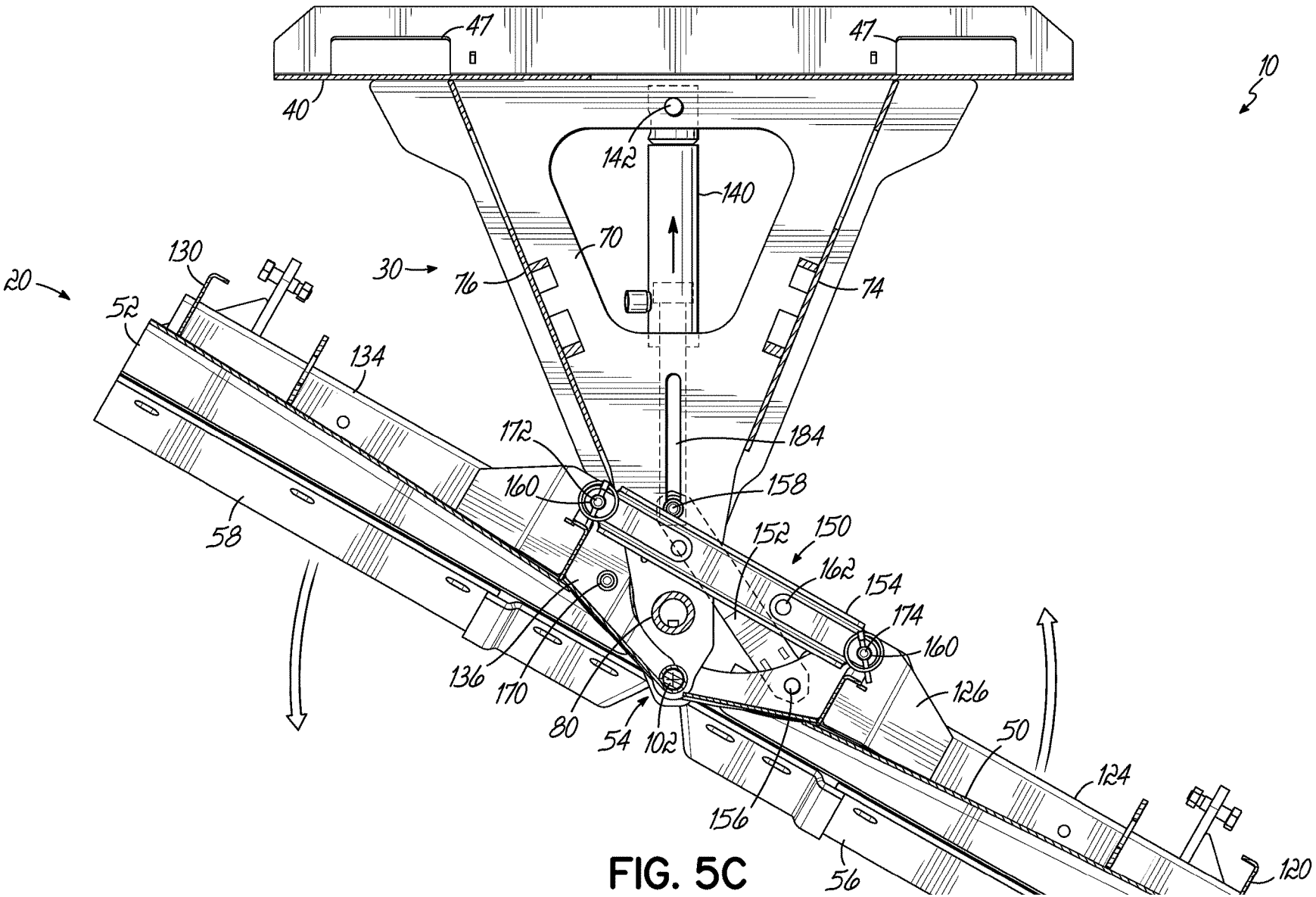
FIG. 5C is a view similar to FIG. 5B, the blades in the angled right position.

Referring to FIGS. 5A-5C, the motion of blades 50, 52 when in the straight blade configuration is illustrated. In FIG. 5A, ram 140 is in its halfway extended position, which positions blades 50, 52 in the straight blade forward position. In FIG. 5B, ram 140 is in its fully retracted position, which positions blades 50, 52 in the straight blade left position. In FIG. 5C, ram 140 is in its fully extended position, which positions blades 50, 52 in the straight blade right position. For smooth operation, pin 158 rides in transversely centered and longitudinally extending slots 184, 186 in plates 70, 72, respectively, (see FIG. 4), and pin 142 is in line with a longitudinal axis of the slots 184, 186 (longitudinal axis of vehicle 44).

Figure 6A:
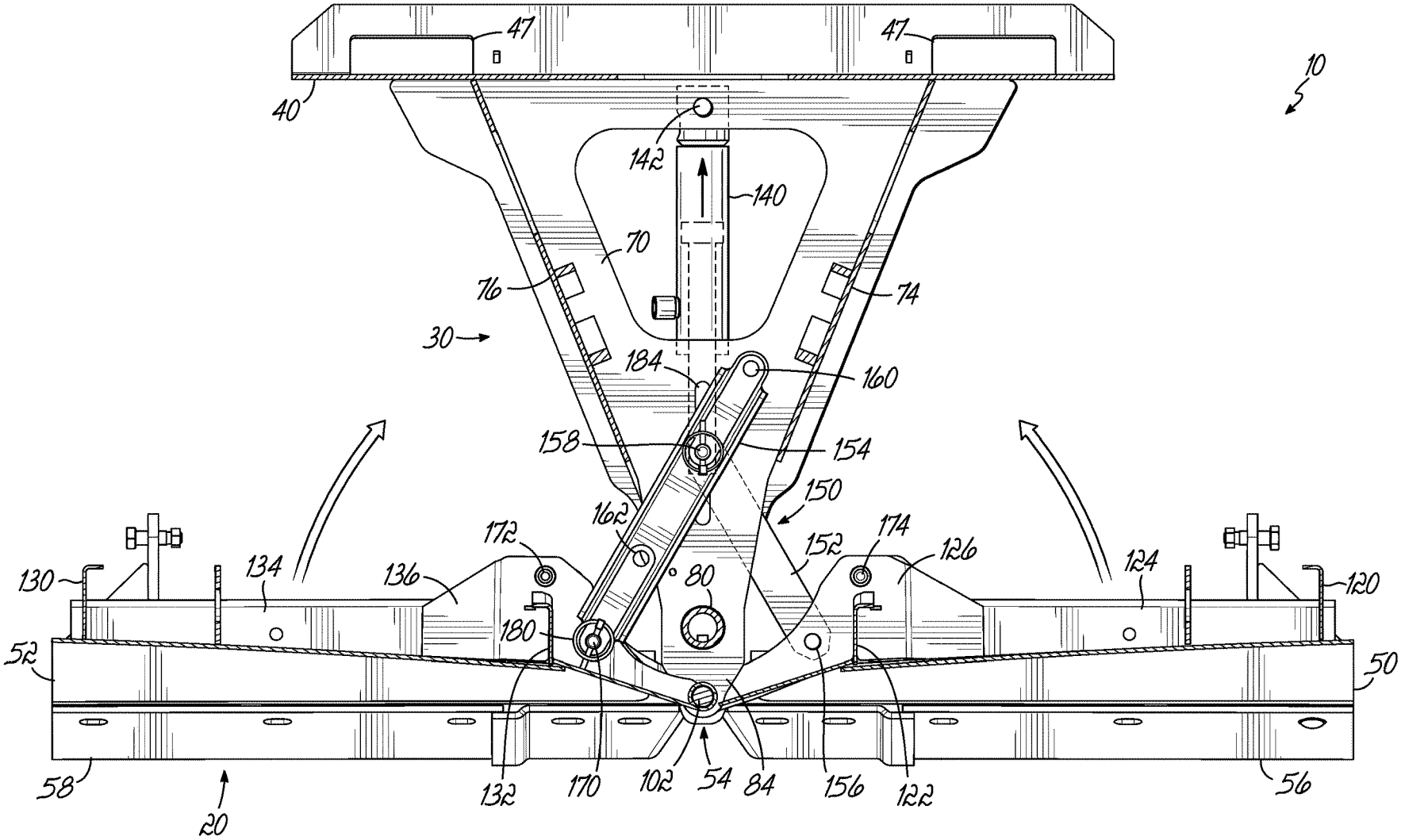
FIG. 6A is a partial cross-sectional view similar to FIG. 5B, the linkage in the second position, in V-blade configuration, the blades in the forward position.
Figure 6B:
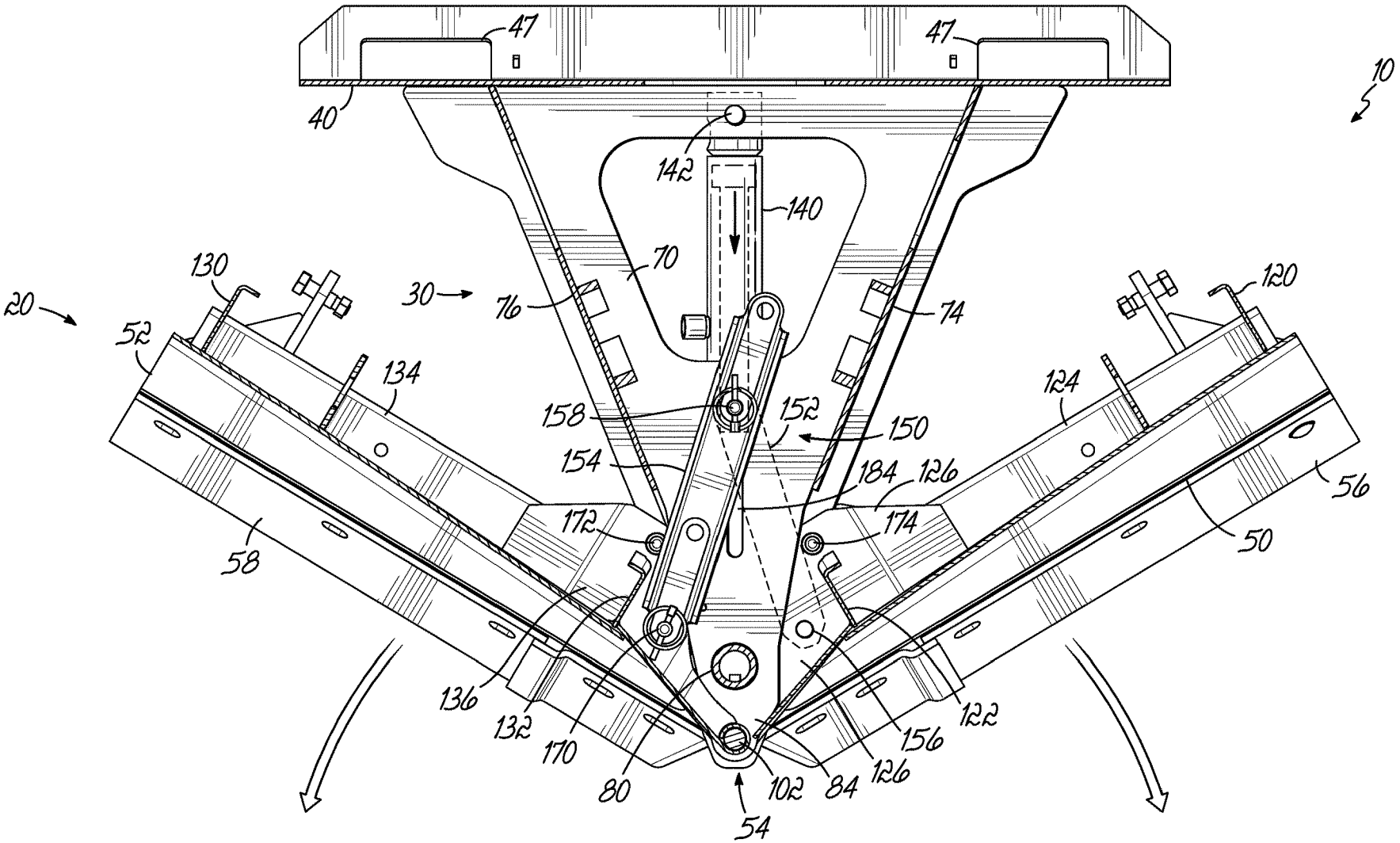
FIG. 6B is a view similar to FIG. 6A, the blades in the rearward swept V position.
Figure 6C:
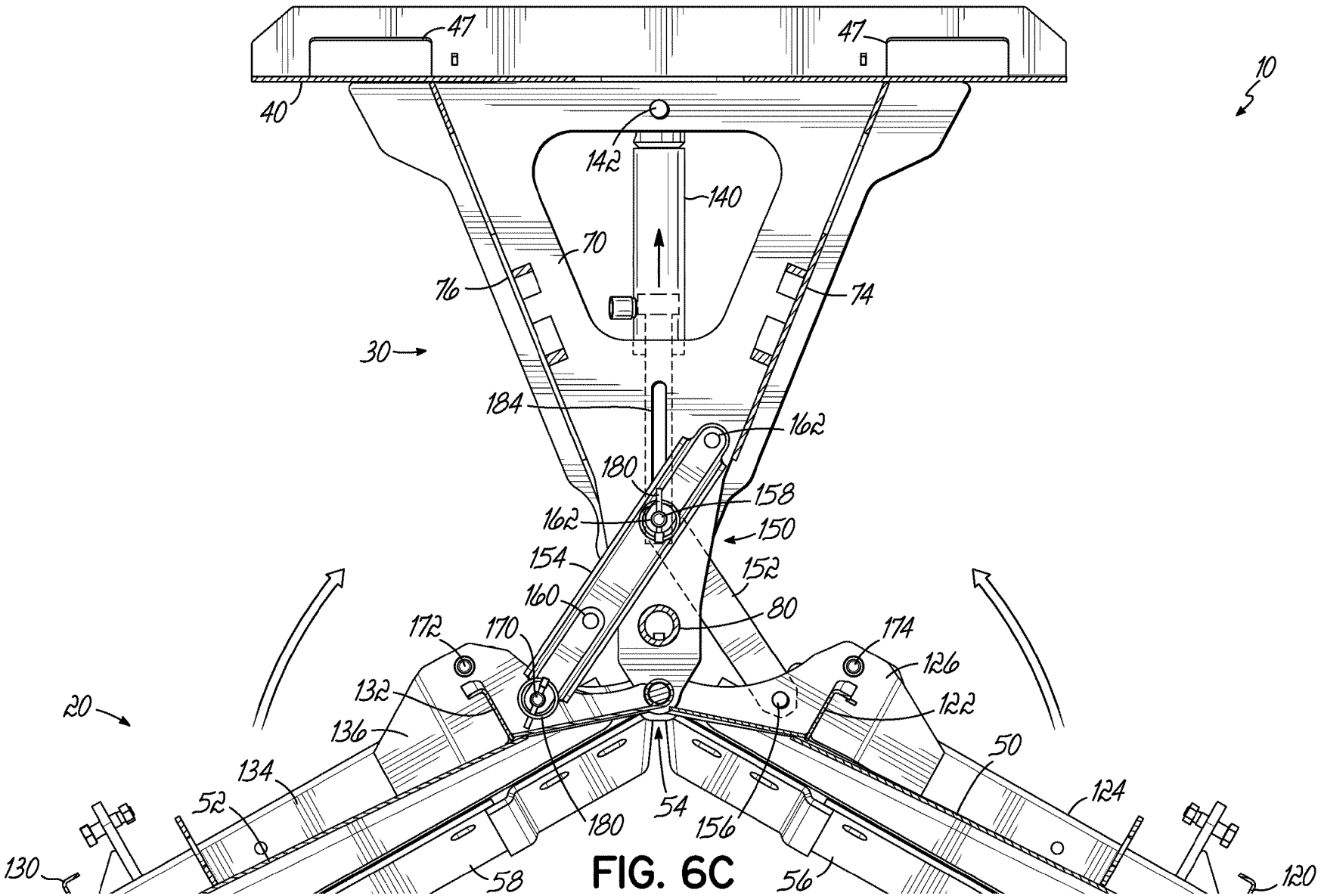
FIG. 6C is a view similar to FIG. 6A, the blades in the forward swept V position.

Referring to FIGS. 6A-6C, the motion of blades 50, 52 when in the V-blade configuration is illustrated. In FIG. 6A, ram 140 is in its halfway extended position, which positions blades 50, 52 parallel to one another and in the forward position. In FIG. 6B, ram 140 is in its fully retracted position, which positions blades 50, 52 in the rearward swept V position. In FIG. 6C, ram 140 is in its fully extended position, which positions blades 50, 52 in the forward swept V position.

While the convertible snow plow of the present invention has particular application for use on ATV's, UTV's, and miniature stand on skid steers, it can also be used on other vehicles as well. Accordingly, the invention is not limited to ATV's, UTV's, and miniature stand on skid steers.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A convertible snow plow comprising:

a support frame having a forward end and a rearward end, said rearward end adapted to be mounted to a vehicle, a pair of plow blades hinged together along inboard ends of said blades at a hinge at said forward end of said support frame, one and only one actuator having opposite ends, one end connected to said support frame, and a two-position linkage connected to the other end of said actuator and to at least one of said blades, wherein when said linkage is in the first position said blades are in a straight blade configuration and said actuator is operable to position said blades in straight blade forward, straight blade left, and straight blade right positions, and wherein when said linkage is in the second position said blades are in a V-blade configuration and said actuator is operable to position said blades in forward swept V and rearward swept V positions.

2. A convertible snow plow comprising:

a support frame having a forward end and a rearward end, said rearward end adapted to be mounted to a vehicle, a pair of plow blades hinged together along inboard ends of said blades at a hinge at said forward end of said support frame, an actuator having opposite ends, one end connected to said support frame, and a two-position linkage connected to the other end of said actuator and to at least one of said blades, wherein when said linkage is in the first position said blades are in a straight blade configuration and said actuator is operable to position said blades in straight blade forward, straight blade left, and straight blade right positions, and wherein when said linkage is in the second position said blades are in a V-blade configuration and said actuator is operable to position said blades in forward swept V and rearward swept V positions, said linkage includes a drive link and a connecting link, each having opposite ends, one end of said drive link is connected to one of said blades and the other end of said drive link is connected to said other end of said actuator, wherein when said linkage is in the first position one end of said connecting link is connected to one of said blades and the other end of said connecting link is connected to the other of said blades, and wherein when said linkage is in the second position said one end of said connecting link is connected to said one of said blades and said other end of said connecting link is connected to said other end of said actuator.

3. The snow plow of claim 2, wherein the connection of said drive link to said actuator rides in a transversely centered and longitudinally extending slot in said support frame.

4. The snow plow of claim 3, wherein said one end of said actuator is connected to said rearward end of said support frame in line with a longitudinal axis of said slot.

5. The snow plow of claim 2, wherein when said linkage is in the first position said one end of said connecting link is connected to said one of said blades at a first location on said one of said blades, and wherein when said linkage is in the second position said one end of said connecting link is connected to said one of said blades at a second different location on said one of said blades.

6. The snow plow of claim 5 wherein said first location is aft of said second location.

7. The snow plow of claim 2, wherein when said linkage is in the first position said connecting link has a first effective length, wherein when said linkage is in the second position said connecting link has a second effective length, and wherein said first effective length is longer than said second effective length.

8. The snow plow of claim 1 wherein said actuator is a single dual-acting hydraulic ram.

9. The snow plow of claim 1 wherein the vehicle is an ATV, a UTV, or a miniature stand on skid steer.

10. A convertible snow plow comprising:

a support frame having a forward end and a rearward end, said rearward end adapted to be mounted to a vehicle, a pair of plow blades hinged together along inboard ends of said blades at a hinge at said forward end of said support frame, one and only one actuator having opposite ends, one end connected to said support frame, and a linkage connected to the other end of said actuator and to at least one of said blades, said actuator operable to position said blades in straight blade forward, straight blade angled left, straight blade angled right, forward swept V, and rearward swept V positions.

11. The snow plow of claim 10 wherein said linkage includes a pair of links, and wherein opposite ends of one of said links are connected in a first manner for straight blade configuration and in a second different manner for V-blade configuration.

12. The snow plow of claim 11 wherein opposite ends of the other of said links are connected in the same manner for straight blade configuration and for V-blade configuration.

13. The snow plow of claim 12 wherein said one of said links is a connecting link and said other of said links is a drive link.

14. A convertible snow plow comprising:

a support frame having a forward end and a rearward end, said rearward end adapted to be mounted to a vehicle, a pair of plow blades hinged together along inboard ends of said blades at a hinge at said forward end of said support frame, an actuator having opposite ends, one end connected to said support frame, and a linkage connected to the other end of said actuator and to at least one of said blades, said actuator operable to position said blades in straight blade forward, straight blade angled left, straight blade angled right, forward swept V, and rearward swept V positions, wherein said linkage includes a pair of links, and wherein opposite ends of one of said links are connected in a first manner for straight blade configuration and in a second different manner for V-blade configuration, wherein opposite ends of the other of said links are connected in the same manner for straight blade configuration and for V-blade configuration, wherein said one of said links is a connecting link and said other of said links is a drive link, wherein only said drive link is connected to said actuator for straight blade configuration and wherein both said links are connected to said actuator for V-blade configuration.

15. The snow plow of claim 10 wherein said actuator is a single dual-acting hydraulic ram.

16. The snow plow of claim 10 wherein the vehicle is an ATV, a UTV, or a miniature stand on skid steer.

17. A method of converting a snow plow from a straight blade configuration to a V-blade configuration comprising:

providing a support frame having a forward end and a rearward end, the rearward end adapted to be mounted to a vehicle, providing a pair of plow blades hinged together along inboard ends of the blades at a hinge at the forward end of the support frame, providing one and only one actuator having opposite ends, one end connected to the support frame, providing a two-position linkage connected to the other end of the actuator and to at least one of the blades, connecting the linkage in the first position, energizing the actuator to position the blades in straight blade forward, straight blade angled left, and straight blade angled right positions, connecting the linkage in the second position, and energizing the actuator to position the blades in forward swept V and rearward swept V positions.

18. A method of converting a snow plow from a straight blade configuration to a V-blade configuration comprising:

providing a support frame having a forward end and a rearward end, the rearward end adapted to be mounted to a vehicle, providing a pair of plow blades hinged together along inboard ends of the blades at a hinge at the forward end of the support frame, providing an actuator having opposite ends, one end connected to the support frame, providing a two-position linkage connected to the other end of the actuator and to at least one of the blades, connecting the linkage in the first position, energizing the actuator to position the blades in straight blade forward, straight blade angled left, and straight blade angled right positions, connecting the linkage in the second position, and energizing the actuator to position the blades in forward swept V and rearward swept V positions, wherein the linkage includes a drive link and a connecting link, wherein opposite ends of the connecting link are connected in a first manner for straight blade configuration and in a second different manner for V-blade configuration, and wherein opposite ends of the drive link are connected in the same manner for straight blade configuration and for V-blade configuration.

19. The method of claim 18 wherein only the drive link is connected to the actuator for straight blade configuration and wherein both links are connected to the actuator for V-blade configuration.

20. The method of claim 17 wherein the actuator is a single dual-acting hydraulic ram.

* * * * *